United States Patent [19]

Vermillion

[11] 4,083,079

[45] Apr. 11, 1978

[54] VACUUM CLEANERS WITH NOZZLE HEIGHT ADJUSTING MECHANISMS

[75] Inventor: Don William Vermillion, Anderson, S.C.

[73] Assignee: The Singer Company, New York, N.Y.

[21] Appl. No.: 719,543

[22] Filed: Sep. 1, 1976

[51] Int. Cl.[2] ..... A47L 5/34

[52] U.S. Cl. ..... 15/354

[58] Field of Search ..... 15/354, 361; 280/43.2

[56] References Cited

U.S. PATENT DOCUMENTS

| | | | |
|---|---|---|---|
| 1,837,315 | 12/1931 | Becker | 15/354 X |
| 1,921,033 | 8/1933 | Kitto | 15/354 |
| 2,048,518 | 7/1936 | Ray | 15/354 X |
| 2,107,016 | 2/1938 | Snyder | 15/354 X |

*Primary Examiner*—Christopher K. Moore

*Attorney, Agent, or Firm*—Alan Ruderman; Edward L. Bell; Robert E. Smith

[57] ABSTRACT

An upright vacuum cleaner having a suction nozzle at the front of the bottom of the chassis is provided with a nozzle height adjusting mechanism for varying the elevation of the rear wheels relative to the chassis to provide a multiplicity of nozzle height positions. The rear axle is journaled on the chassis and includes a pair of off-set legs on which a respective rear wheel is mounted. A wheel bracket is journaled on one end of one off-set crank leg and supports a guide member and a helical end cam track. A follower member having a conjugate helical surface rides on the cam track and supports a locking member on its upper surface. The locking member is secured to the chassis and includes a plurality of detent teeth between each two of which at least one tooth on the follower member is received to lock the follower in a selected position. Turning of the knob allows the follower tooth to slide over the detent teeth to allow rotation of the follower which effects a vertical movement thereof on the cam track surface.

4 Claims, 3 Drawing Figures

VACUUM CLEANERS WITH NOZZLE HEIGHT ADJUSTING MECHANISMS

BACKGROUND OF THE INVENTION

This invention relates to vacuum cleaners and more particularly to a vacuum cleaner of the floor cleaning type having means for selectively raising and lowering the suction inlet nozzle in accordance with the type of floor covering being cleaned.

Vacuum cleaners of the floor cleaning or upright type generally include a chassis having a nozzle at the bottom thereof through which air is sucked by an air moving motorblower unit, a rotary brush mounted adjacent the nozzle for contacting the floor surface to agitate and loosen the dirt so that it may be sucked free of the surface, and wheels mounted at the front and the rear of the chassis for supporting the cleaner for rolling on the floor. Since these cleaners are called upon to clean many different kinds of modern floor coverings of varying pile height, it is known to vary the chassis elevation to locate the nozzle at a level above the surface to provide proper suction and flow path of the particular type of floor covering and to position the brush at the proper height to agitate the dirt on the surface. The many different kinds of modern floor coverings require that, for the cleaner to clean properly, a plurality of nozzle height elevations be provided. Since the number and type of floor covering is ever increasing, it is desireable that a nozzle height adjusting mechanism design be flexible to take future trends in floor covering design into account. However, cost of manufacture and assembly should not be compromised by such a design.

SUMMARY OF THE INVENTION

Accordingly, the primary object of the present invention is to provide a nozzle height adjusting mechanism for an upright vacuum cleaner providing a multiple number of nozzle height positions which number may be changed by replacing a single part.

It is another object of the present invention to provide an upright vacuum cleaner having a nozzle height adjusting mechanism which is economical to manufacture and which is adapted for different design settings merely by changing one part.

Accordingly, this invention provides a nozzle height adjusting mechanism for a suction cleaner having a suction intake nozzle for floor cleaning, and front and rear wheels for supporting the cleaner for movement on the floor. The rear wheels are mounted on off-set ends of a rear axle formed with a central portion journaled in the rear of the chassis. A guide member and a helical end cam concentric with the guide member are journaled on one off-set end of the rear axle. A slide member having a cam follower is positioned on the helical cam and upon rotation rides up and down on the cam surface. The slide member includes an annular ledge having at least one tooth and supports a hollow cylindrical locking member that is secured to the chassis. A plurality of detent teeth are disposed circumferentially about the interior of a central opening in the locking member for receiving the tooth of the slide member to lock the slide member between selected teeth. The slide member is manually turned thereby allowing the tooth to slip over the crest of selected teeth of the locking member which allows the slide member follower to vertically ride on the helical cam surface. The present invention is an improvement over the device disclosed in U.S. Pat. No. 2,048,518.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
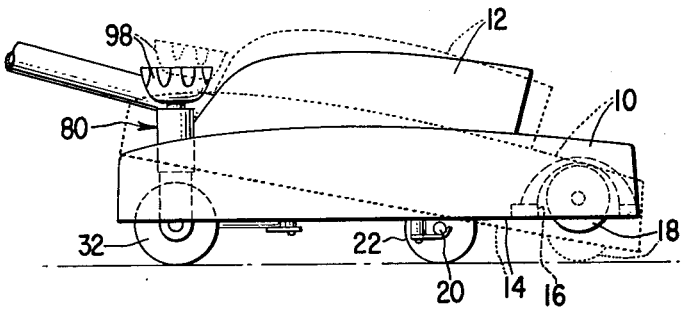
FIG. 1 is an elevational view partially broken away and sectioned of a vacuum cleaner embodying the present invention with the solid lines illustrating a high nozzle height position and the dotted lines illustrating a low nozzle height position.
Figure 2:
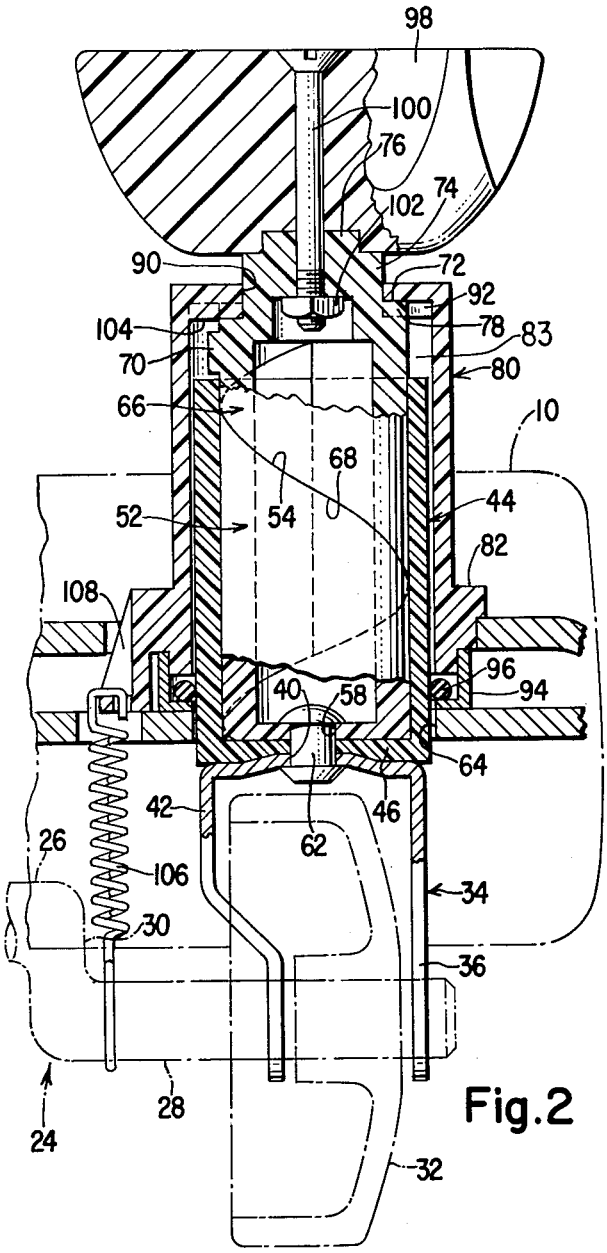
FIG. 2 is a cross-sectional view of the nozzle height adjusting mechanism illustrated in FIG. 1 greatly enlarged, and illustrating a portion of the cleaner in phantom.
Figure 3:
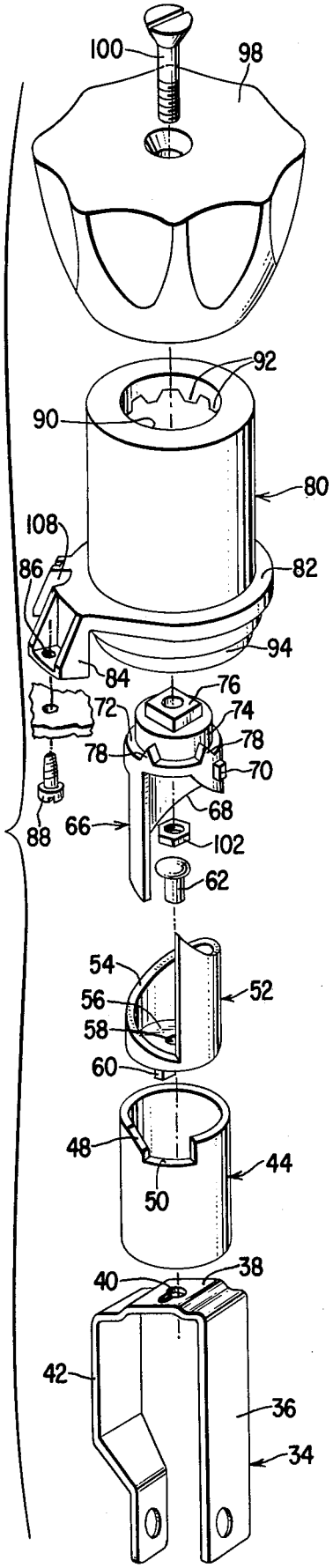
FIG. 3 is a disassembled perspective view of the nozzle height adjusting mechanism illustrated in FIG. 2.

Referring now to the accompanying drawings, wherein like reference numerals denote similar parts throughout the various views, there is disclosed a substantial portion of a vacuum cleaner of the type known as a floor cleaner, or upright suction cleaner. A cleaner of this type is shown in its entirety in the U.S. Pat. No. 3,163,439 which issued on Dec. 29, 1964, to the same Assignee as the present invention, and since the propelling handle, dust bag and motor-blower unit are conventional and form no part of the present invention and are not necessary for a clear understanding thereof, reference may be had to said patent for a full disclosure of the complete cleaner.

The vacuum cleaner includes a chassis 10 on the top of which is secured a hood 12. Mounted on the bottom of the chassis is an electric motor and a pair of fan impellers which communicate air through a discharge duct between the chassis, an access plate 14 and the hood, with a dust bag assembly. Reference may be had in the aforesaid U.S. Pat. No. 3,163,439, for a full disclosure of the motor, fans and bag assembly. A vacuum cleaner inlet nozzle 16 is formed in the access plate 14 and the forward portion at the bottom of the chassis and communicates the dirt laden air with the fans. A rotary floor brush assembly 18 is mounted in the nozzle above the opening 16 so as to contact the floor surface when the cleaner nozzle is at its proper elevation for the floor to be cleaned. Conventionally a belt (not shown) drives the brush assembly from a spindle on a motor-fan shaft.

Mounted in a recess formed at the bottom of the chassis is a front wheel axis 20 which rotatably mounts a pair of wheels 22 (only one of which is illustrated). A rear axle 24 including a central portion 26 having off-set leg portions 28 (only one of which is illustrated) depending from respective crank arms 30, is journaled at the central portion on bearing recesses formed at the bottom of the access plate at the rear of the housing. Rotatably mounted on the free extremity of each off-set leg 28 is a respective hollow interior rear wheel 32 (only one of which is shown). As is well known in the prior art and as described in the aforesaid U.S. Pat. No. 3,163,439, turning of the rear axle about the central portion 26 results in the raising or lowering of the rear wheels 32 relative to the chassis. In other words, a lowering or raising of the chassis and the nozzle relative to the rear wheels results when the rear axle 24 is turned in its bearing seats.

Journaled on one of the off-set legs 28 of the rear axle in a location to straddle the rear wheel 32 is a metal wheel bracket 34. The bracket is substantially "U" shaped having a first downwardly depending leg 36 a cross leg 38 including a key hole slot 40 and a second downwardly depending leg 42 stepped inwardly toward the leg 36 so as to be received within the hollow interior of the wheel 32. Positioned on the top of the leg 38 is a plastic hollow cylindrical guide memeber 44 which is open at the top and includes an end face 46 at the bottom having a key hole slot of configuration similar to that of the slot 40 and is positioned on the bracket with the slots aligned. A portion adjacent the upper surface of the guide 44 is stepped downwardly at an incline 48 to an undercut portion 50 for purposes which will hereinafter become clear.

Concentrically positioned within the guide member 44 is a plastic substantially cylindrical first slide member 52 hollowed out in the center and formed with a helical edge 54 spaced about the longitudinal axis of the member 52. The surface of the edge 54 is spaced at a constant radius from the axis of the member 52 and defines an end cam track. The bottom of the member 52 includes a substantially flat face 56 having an aperture 58 and including a tab 60 extending from the bottom surface of the face adjacent the aperture. The member 52 is positioned within the guide 44 with the tab 60 located within the elongated portions of the key-hole slots in the guide 44 and the wheel bracket 34. In this position the aperture 58 is in alignment with the enlarged openings of the key-hole slots in the members 44 and 34. A rivet 62 or the like is received within the opening 58 and through the enlarged portion of the key-hole slots in the members 44 and 34 and is locked by conventional means to secure the members 52, 44, 34 together. This assembly is positioned within an opening 64 formed in the chassis 10 of the cleaner and extends vertically upwardly therefrom.

Positioned within the guide member 44 and supported on the surface 54 of the slide 52 is a second plastic slide member 66 of a substantially cylindrical configuration and including a bottom edge 68 formed with a helical surface that is conjugate with the helical cam track 54. Thus, the member 66 is supported on the member 52 and its vertical position is determined by the relative position of the surfaces 54 and 68. The slide member 66 thus defines a cam follower having a follower surface 68 whose elevational position is effected by rotation of the member 66. Projecting radially outwardly from the cylindrical wall of the slide member 66 is a stop limiter tab 70 which in the lowermost position of the member 66 slides on the inclined surface 48 and is received within the undercut clearance 50 of the member 44. The stop limiter 70 is effective to limit the upward movement of the second slide member 66 as hereinafter will become clear. The member 66 is formed with an annular upper end surface, or ledge 72 having a radially reduced boss 74 projecting upwardly and a substantially square key 76 centrally located thereon. Circumferentially positioned about the annular surface 72 of the member 66 between the outer cylindrical wall and the cylindrical wall of the boss 74 is one or more teeth 78. As will hereinafter become clear at least one tooth 78 is required but others may be desirable for added strength.

Positioned concentrically about the members 44, 52 and 66, is a substantially cylindrical hollow locking member 80 having a flange portion 82 adjacent the bottom thereof and an interior cylindrical surface 83 defining a substantially central axial opening. Extending downwardly from the flange is a bracket 84 having an aperture 86 for receiving a screw 88 or the like which secures the cylindrical member 80 to the chassis 10 of the vacuum cleaner. The diameter of the central opening 90 at the top of the cylindrical locking member 80 is substantially the same as that of the boss 74 of the member 66 which is received therethrough. Spaced below the upper surface radially outwardly from the central opening 90 are a plurality of teeth 92 which are circumferentially equally spaced about the opening 90. These teeth act as detents for the tooth or teeth 78 to provide positive locking increments for the rotation of the member 66. The number of teeth 92 determine the number of nozzle height adjusting steps provided by the mechanism. Since the cylindrical locking member 80 is formed from a plastic molded material the number of teeth 92 can be varied for different applications merely by changing this portion of the mold. The ledge 72 of the number of teeth 78 on the slide member 66 should be divisible into the number of teeth 92 on the member 80 for obvious reasons. Thus, for example, if 8 stops and therefore 8 teeth 92 are desired the number of teeth 78 on the member 66 may be 2 or 4 if more than one tooth 78 is desired for additional strength. Positioned about the lower portion of the cylindrical member 80 is a cap 94 having a central opening sized to receive the guide member 44. A frictional member such as an "O" ring 96 is positioned within the cap 94 and acts against the exterior wall of the guide 44 to provide frictional resistance to overcome the need for close tolerences between the members 80 and 44.

Mounted above the member 88 exteriorly of the cleaner chassis 10 is an operator engageable knob 98 which is secured to the slide member 66 by conventional means such as screw 100 and nut 102 and by the key member 76 received within a corresponding opening at the bottom of the knob 98. Turning of the knob 98 thereby effects a turning of the member 66 to change the elevational relationship between the members 66 and 52. The stop limiter 70 on the member 66 acts against a projection 104 formed on the interior of the upper surface of the locking member 80 so as to limit the upward movement of the cleaner chassis. A coil spring 106 may be attached at one end to a projection 108 formed on the locking member 80 and at its other end to the leg 28 of the rear axle to prevent the wheels from dropping downwardly when the cleaner is lifted off the floor.

In operation since the wheels and the off-set legs 28 are vertically fixed relative to the floor the guide member 44 and the lower slide member are fixed vertically relative to the floor. The upper slide member 66 is vertically positioned by the follower surface 68 as it rides on the cam surface 54 when the knob 98 is rotated. The locking cylinder is vertically supported on the ledge 72 of the slide member 66 and since it is secured to the chassis its elevation and that of the chassis is determined by the slide member 66 as the central portion 26 of the rear axle pivots about the wheels 32. The detent teeth 92 determine the amount of rotation of the slide member 66 positively.

It should be clear that a simple and inexpensive nozzle height adjusting mechanism has been disclosed in this application. Numerous alterations of the structure herein disclosed will suggest themselves to those skilled in the art. However, it is to be understood that the present disclosure relates to a preferred embodiment of the invention which is for purposes for illustration only and not to be construed as a limitation of the invention. All such modifications which do not depart from the spirit of the invention are intended to be included within the scope of the appended claims.

Having set forth the nature of the invention, what is claimed herein is:

1. A nozzle height adjusting mechanism for a suction cleaner having a chassis including a suction nozzle inlet at the bottom thereof and first and second sets of wheels for supporting said chassis for movement on a floor surface, said mechanism comprising: first axle means including a central portion journaled on said chassis and having offset legs formed on opposite ends of said central portion for journaling said first set of wheels, second axle means longitudinally spaced from the first axle for journaling said second set of wheels on said chassis, means including a substantially cylindrical guide member and a first slide member concentric therewith journaled on an off-set leg, said first slide member including a helical end cam track disposed about the axis of the guide member, a hollow cylindrical locking member secured to said chassis and including a substantially central axial opening for receiving said guide member and said first slide member, said locking member including a plurality of detent teeth disposed circumferentially within said central axial opening, a second slide member positioned within said locking member having a cam follower positioned on said cam track and an annular ledge for supporting the locking member, said ledge including at least one tooth positionable between each two adjacent detent teeth of said locking member, and operator influenced means for turning said second slide member so as to reposition said tooth between other detent teeth and reposition the follower on said track thereby to change the elevation of the chassis relative to said wheels.

2. A nozzle height adjusting mechanism as recited in claim 1 wherein said cam follower comprises a helical surface at the bottom end of said second slide member, said helical surface being the conjugate of said helical cam track.

3. A nozzle height adjusting mechanism as recited in claim 1 wherein said detent teeth extend radially inwardly from said central axial opening.

4. A nozzle height adjusting mechanism as recited in claim 2 wherein said first and second slide members are substantially cylindrical in shape having the helical surfaces spaced at a constant radius from the axes of the respective slide members.

* * * * *